US007063472B2

(12) United States Patent
Matsuda et al.

(10) Patent No.: US 7,063,472 B2
(45) Date of Patent: Jun. 20, 2006

(54) SHEET SKEW CORRECTING APPARATUS AND IMAGE FORMING APPARATUS

(75) Inventors: Michihiro Matsuda, Ibaraki (JP); Yasushi Hashimoto, Ibaraki (JP); Shingo Takai, Ibaraki (JP); Hiroshi Suzuki, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 130 days.

(21) Appl. No.: 10/224,281

(22) Filed: Aug. 21, 2002

(65) Prior Publication Data

US 2003/0044217 A1 Mar. 6, 2003

(30) Foreign Application Priority Data

Aug. 31, 2001 (JP) ..... P.2001-263195

(51) Int. Cl.
*B41J 11/00* (2006.01)

(52) U.S. Cl. ..... 400/579; 400/582; 271/229; 271/236; 271/246; 271/258.01

(58) Field of Classification Search ..... 400/579, 400/703, 582; 271/229, 236, 246, 258.01
See application file for complete search history.

(56) References Cited

U.S. PATENT DOCUMENTS 4,523,832 A 6/1985 Strutt et al.
5,091,754 A 2/1992 Abe et al.
5,156,386 A * 10/1992 Kitajima et al. ..... 271/3.04
5,168,317 A * 12/1992 Takano ..... 399/125
5,261,754 A * 11/1993 Sugiura ..... 400/636.3
5,335,904 A * 8/1994 Ryuzaki ..... 271/272
5,356,263 A * 10/1994 Miller ..... 414/790.7
5,362,041 A * 11/1994 Ryuzaki et al. ..... 271/236
5,392,703 A * 2/1995 Makarchuk et al. ..... 101/92
5,702,191 A 12/1997 Kakizaki et al.
5,727,784 A * 3/1998 Sagawa ..... 271/265.01
5,787,331 A 7/1998 Ohkuma et al.
5,881,340 A * 3/1999 Stickney et al. ..... 399/110
5,933,697 A * 8/1999 Onodera et al. ..... 399/406
6,155,561 A * 12/2000 Mandel ..... 271/254
6,185,403 B1 2/2001 Toyoshima et al.
6,228,441 B1 5/2001 Suzuki et al.
6,402,139 B1 * 6/2002 Kanno ..... 271/240
6,493,534 B1 * 12/2002 Sawanaka et al. ..... 399/316
6,602,008 B1 * 8/2003 Yamagishi et al. ..... 400/619
6,634,634 B1 * 10/2003 Sugimura ..... 271/9.11
6,668,711 B1 * 12/2003 Villiger ..... 100/41

FOREIGN PATENT DOCUMENTS

JP 11-208940 8/1999

* cited by examiner

*Primary Examiner*—Ren Yan
*Assistant Examiner*—Dave A. Ghatt
(74) *Attorney, Agent, or Firm*—McGinn & Gibb, PLC

(57) ABSTRACT

A sheet skew correcting apparatus, incorporated in a printer or the like to correct a phenomenon of obliquely feeding a sheet called skewing. The apparatus includes a transporting path in which the sheet is transported, a pair of registration rollers, a pair of timing rollers disposed upstream from the registration rollers, and a paper guide having a first and a second curved portion and constituting the transporting path. When a sheet fed into the transporting path abuts against a contact point of a registration roller pair, the sheet is further transported by an arbitrary distance in the sheet transporting direction. First and second curves are then formed in the sheet in the first and second curved portions. Then the registration roller pair is rotated in the direction opposite to the sheet transporting direction, the front end of the sheet uniformly abuts against the contact point of the registration roller pair to correct skew.

31 Claims, 4 Drawing Sheets

SHEET SKEW CORRECTING APPARATUS AND IMAGE FORMING APPARATUS

BACKGROUND OF THE INVENTION

1. Field of the Invention

The present invention relates to a sheet skew correcting apparatus for a copier, a printer, or the like, and also to an image forming apparatus using it.

2. Background Art

Conventionally, a sheet transporting apparatus which is incorporated in a printer or the like is often provided with a sheet skew correcting apparatus in order to correct a phenomenon of obliquely feeding a sheet, or a phenomenon which is so-called skewing.

FIG. 6 is a front view of a conventional sheet skew correcting apparatus which is incorporated in a printer or the like. The apparatus is configured by: a driving roller (hereinafter, referred to as registration drive roller 1) which, in a sheet transporting path connecting a sheet feeding apparatus to a transferring apparatus, causes the front end of a sheet transported in a sheet transporting path disposed upstream from the transferring apparatus, to abut against the roller, thereby registering the front end of the sheet on the nip line of the roller; a driven roller (hereinafter, referred to as registration idler roller 2) which is similarly disposed; a driving roller (hereinafter, referred to as timing drive roller 4) which is used for transporting the sheet in a sheet transporting path disposed upstream from the registration rollers; a driven roller (hereinafter, referred to as timing idler roller 5) which is similarly disposed; and a sensor 20 which detects the passing of a sheet 22 over a contact point 27 between the timing drive roller 4 and the timing idler roller 5.

The sheet skew correcting apparatus corrects skew of the sheet 22 in the following manner. The timing drive roller 4 and the timing idler roller 5 are rotated in the directions of the arrows shown in FIG. 6, to cause the sheet 22 fed out from the sheet feeding apparatus to abut against a contact point 23 between the registration drive roller 1 and the registration idler roller 2 which are stopping. Thereafter, the timing drive roller 4 and the timing idler roller 5 are rotated in the directions of the arrows shown in FIG. 7 to feed the sheet 22 by an arbitrary distance, whereby the sheet is curved in a range between the registration drive roller 1 and the registration idler roller 2, and the timing drive roller 4 and the timing idler roller 5. The registration drive roller 1 and the registration idler roller 2 are rotated in the directions of the arrows shown in FIG. 7. Thereafter, the curved portion of the sheet is pressed by a buffer paper guide 28 in a direction along which the front end of the sheet 22 is aligned with the contact point 23, whereby the front end of the sheet 22 is aligned with the contact point 23 to correct skew of the sheet 22.

FIG. 8 is a diagram showing the curved state of the sheet 22 in the conventional sheet skew correcting apparatus shown in FIGS. 6 and 7. When the skewed sheet 22 is aligned with the nip line of the registration drive roller 1 and the registration idler roller 2, the curve of the side which first butts against the contact point 23 is larger as indicated by B, and that of the side which lately butts against the contact point is smaller as indicated by C. As a result, the buffer paper guide 28 which presses the curved portion of the sheet 22 presses mainly only the side of the larger curve, so that the force of pressing the front end of the sheet 22 on the side which lately butts is reduced. Therefore, there occurs a phenomenon that the sheet 22 in the range from the curved portion to the contact point 23 is rotated generally by the pressing on the curved portion of the sheet 22 by the buffer paper guide 28, about an intersection 0 of a ridge line a-a' on the side of the registration drive roller 1, and a ridge line b-b' connecting the starting points of the sheet 22 on the side of the timing drive roller 4. This phenomenon remarkably occurs particularly in a sheet of high rigidity, such as cardboard.

In the above-mentioned conventional sheet skew correcting apparatus, when, in order to align a sheet with the nip portion of the registration roller pair, the sheet is sent to the registration roller pair by a distance which is longer than the length of the sheet transporting path between the timing roller pair and the registration roller pair to form a curve in the sheet, the force of pressing the front end of the sheet on the side which lately butts against the registration roller pair, against the registration roller pair is reduced. Therefore, a portion which fails to abut against the nip line of the registration roller pair is produced in the front end of the sheet. This causes a problem in that a necessary skew correcting ability cannot be obtained.

SUMMARY OF THE INVENTION

It is an object of the invention to provide a sheet skew correcting apparatus which can solve the problem of the conventional art, and which causes the front end of a sheet to abut against a nip line of a registration roller pair to exhibit an excellent skew correcting ability. It is another object of the invention to provide an image forming apparatus which causes the front end of a sheet to abut against a nip line of a registration roller pair to exhibit an excellent skew correcting ability.

The objects can be attained by a sheet skew correcting apparatus in which the apparatus comprises: a pair of registration rollers which are disposed in a transporting path connecting a sheet feeding apparatus to a transferring apparatus and upstream from the transferring apparatus; and a pair of timing rollers which are disposed upstream from the pair of registration rollers, detecting means for detecting passing of a sheet through the pair of timing rollers is disposed, the apparatus further comprises: driving means configured by a stepping motor for driving the pair of registration rollers in a forwardly and reversely rotatable manner; driving means configured by a stepping motor for the pair of timing rollers; and a control circuit which controls operations of the driving means of the pair of registration rollers and the pair of timing rollers, a first curved portion is disposed in a paper guide forming a transporting path between the pair of registration rollers and the pair of timing rollers, and a second curved portion is disposed downstream from the first curved portion, wherein a position of a front end of a sheet is detected by the sheet detecting means to know arrival of the sheet front end position at the registration rollers, and, when the sheet is transported by a distance which is longer than a length of a sheet transporting path between the pair of timing rollers and the pair of registration rollers to uniformly align the front end of the sheet with a nip line of the pair of registration rollers, a difference of a curving amount of the sheet due to skew of the sheet is absorbed by the second curved portion to uniformalize curving of the sheet in the first curved portion, whereby a force of pressing the front end of the sheet against the pair of registration rollers can be uniformalized to exhibit an excellent skew correcting ability.

BRIEF DESCRIPTION OF THE DRAWINGS

FIG. 6 is a diagram showing the operation of a conventional sheet skew correcting apparatus which is incorporated in a printer or the like.

FIG. 7 is a diagram showing the operation of the conventional sheet skew correcting apparatus which is incorporated in a printer or the like.

FIG. 8 is a plan view illustrating a skewing state of a sheet in a conventional printer or the like.

DETAILED DESCRIPTION OF THE PREFERRED EMBODIMENTS

Figure 1:
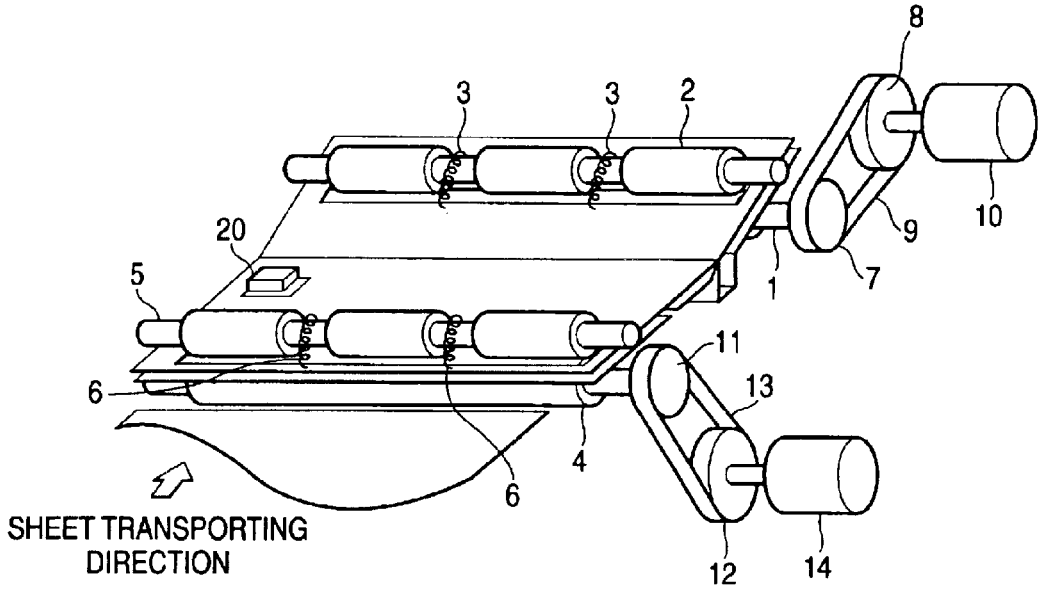
FIG. 1 is a diagram of the sheet skew correcting apparatus of the invention.

Hereinafter, the invention will be described with reference to the drawings showing an embodiment of the invention. FIG. 1 is a perspective view showing an example in which an image forming apparatus having a sheet skew correcting apparatus of the invention is embodied. Referring to FIG. 1, a registration idler roller 2 is made of a material such as a plastic or a metal, which is harder, which has a smoother surface, and which is less deformed than that of a registration drive roller 1. The registration idler roller 2 is pressed by springs 3 against a registration drive roller 1 configured by an elastic member of rubber hardness of 85° or higher. When the registration drive roller 1 is rotated, the registration idler roller 2 is rotated in the direction opposite to that of the registration drive roller 1. A timing idler roller 5 is pressed by springs 6 against a timing drive roller 4. When the timing drive roller 4 is rotated, the timing idler roller 5 is rotated in the direction opposite to that of the timing drive roller 4. In an end portion of the registration drive roller 1, disposed are a pulley 7, a pulley 8, and a timing belt 9 which serve as a mechanism for transmitting a rotation power supplied from a stepping motor 10 functioning as a power source for rotating the registration drive roller 1. In an end portion of the timing drive roller 4, disposed are a pulley 11, a pulley 12, and a timing belt 13 which serve as a mechanism for transmitting a rotation power supplied from a stepping motor 14 functioning as a power source for rotating the timing drive roller.

Figure 2:
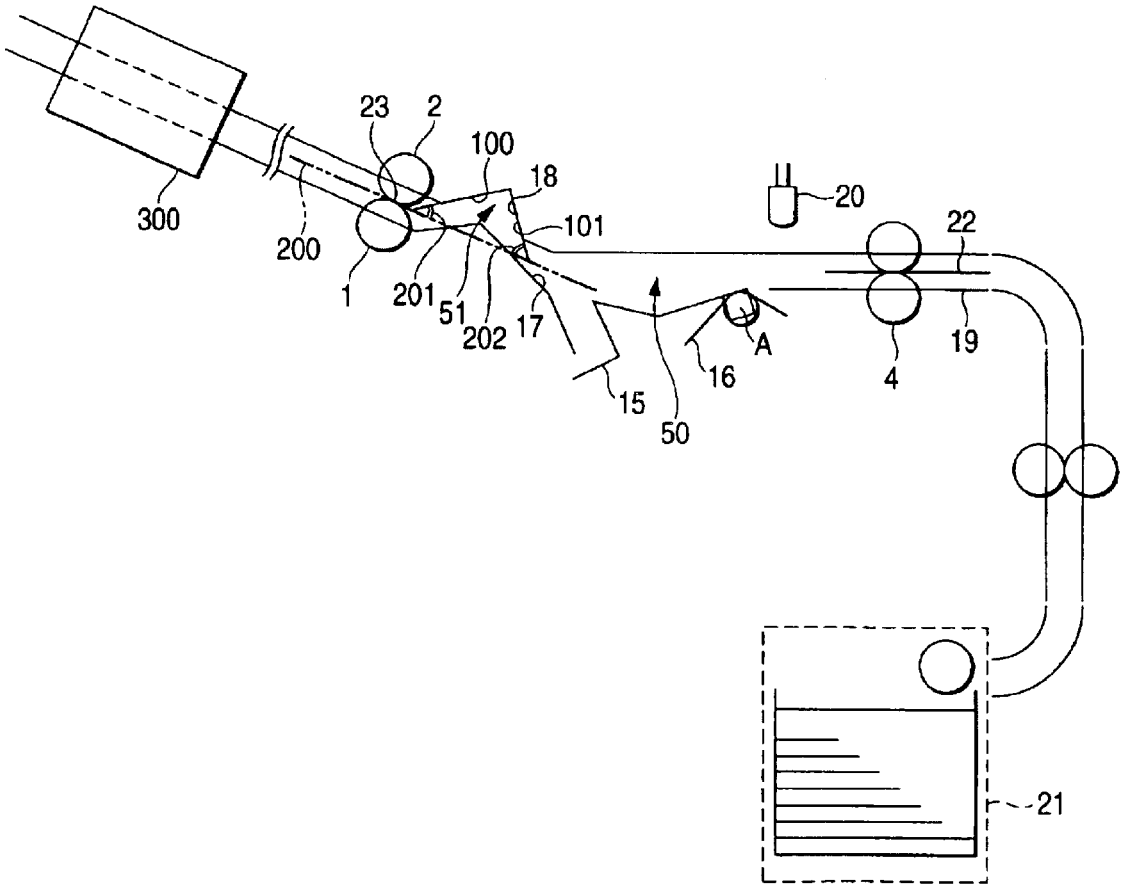
FIG. 2 is a diagram of the sheet skew correcting apparatus of the invention.

FIG. 2 is a side view schematically showing the embodiment. Referring to FIG. 2, a buffer paper guide 15 is pressed by a torsion coil spring 16 against a paper guide 17 while being swung about the point A. A paper guide 18 is disposed above the buffer paper guide 15. The paper guide 18 and buffer paper guide constitutes a first curved portion 50 of the transporting path.

The paper guide 17 has a shape which is expanded toward the registration idler roller 2 upstream from the registration drive roller 1. The registration drive roller 1 and the registration idler roller 2 are in mutual contact at a contact point 23. The paper guide 17 is configured so that the front end of a sheet 22 is first in contact with the registration idler roller 2 and then arrives the contact point 23 while sliding over the surface of the registration idler roller 2. The paper guide 18 has a first inclining portion 100 and a second inclining portion 101. The second inclining portion 100 abuts on the first inclining portion 101 from up stream. The first inclining portion 100 tapers the transporting path gradually in the transporting direction. The second inclining portion 101 tapers the transporting path gradually towards upstream. When an imaginary plane 200 being tangent to the surfaces of both of the registration drive roller 1 and the registration idler roller 2 and passing through the contact point 23 is taken as a reference, an angle 201 between the first inclining portion 100 and the imaginary plane 200 is 45° or less, and an angle 202 between the second inclining portion 101 and the imaginary plane 200 is 45° or more.

The first inclining portion 100 and the second inclining portion 101 constitute a side of a second curved portion 51 of the transporting path which is disposed downstream to the first curved portion 50.

In order to detect the sheet 22 transported from a sheet feeding apparatus 21, a sensor 20 which detects the front end of a sheet and the presence of a sheet is disposed downstream from the timing drive roller 4.

Figure 5:
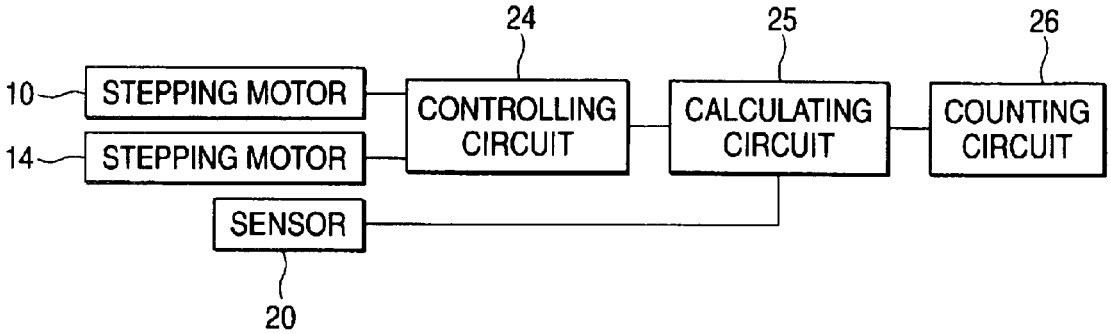
FIG. 5 is a block diagram illustrating a controlling section of the sheet skew correcting apparatus of the invention.
Figure 6:
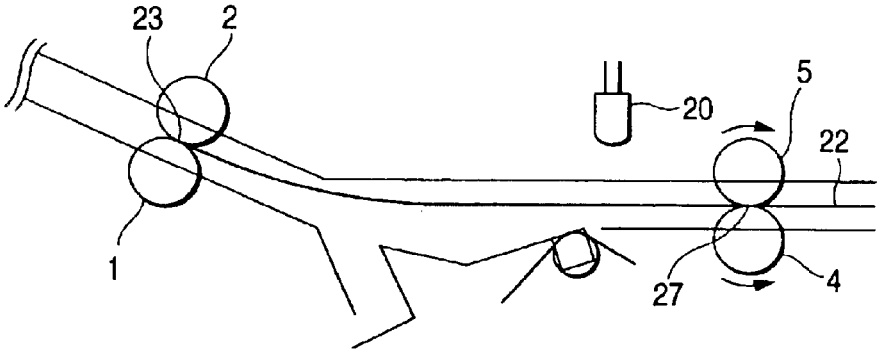
Figure 7:
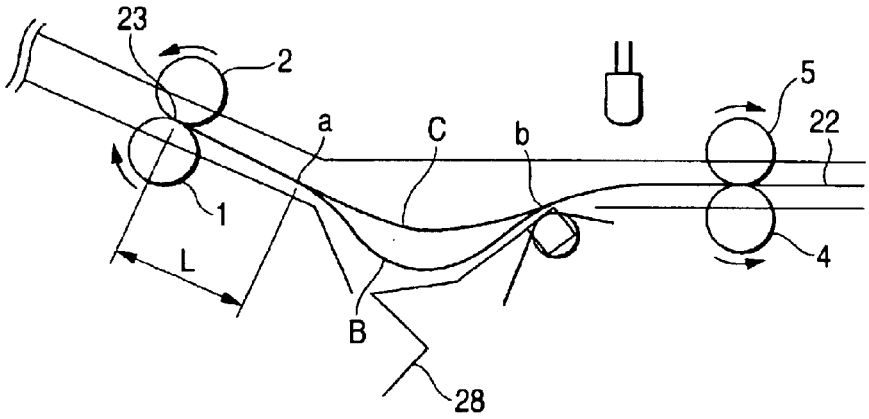
Figure 8:
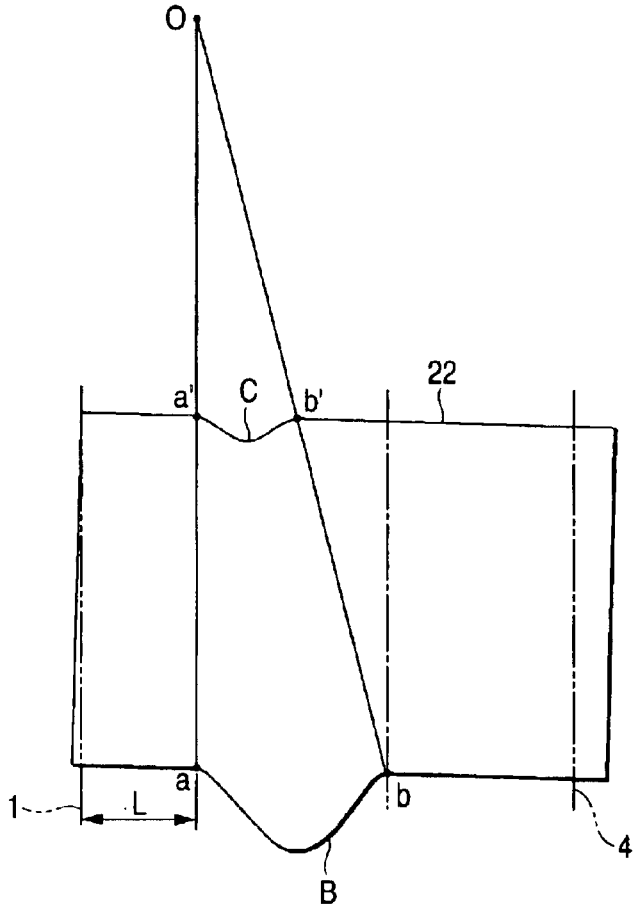

FIG. 5 is a block diagram illustrating a controlling section of the sheet skew correcting apparatus of the invention. In FIG. 5, numeral 25 denotes a calculating circuit. A counting circuit 26 which counts the numbers of steps respectively supplied to the stepping motors 10 and 14 is connected to the calculating circuit 25. A controlling circuit 24 which controls the operations of the stepping motors 10 and 14 in accordance with instructions from the calculating circuit 25 is connected to the calculating circuit 25. The stepping motors 10 and 14 are connected to the controlling circuit 24. The sensor 20 which detects the front end of a sheet in accordance with instructions from the calculating circuit 25 is connected to the calculating circuit 25.

Figure 3:
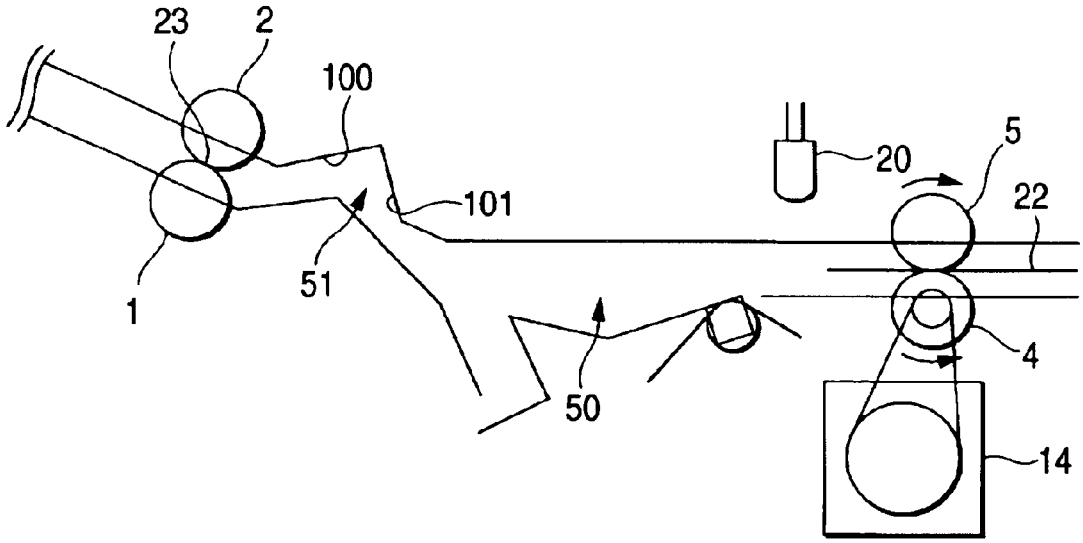
FIG. 3 is a diagram showing the operation of the sheet skew correcting apparatus of the invention.
Figure 4:
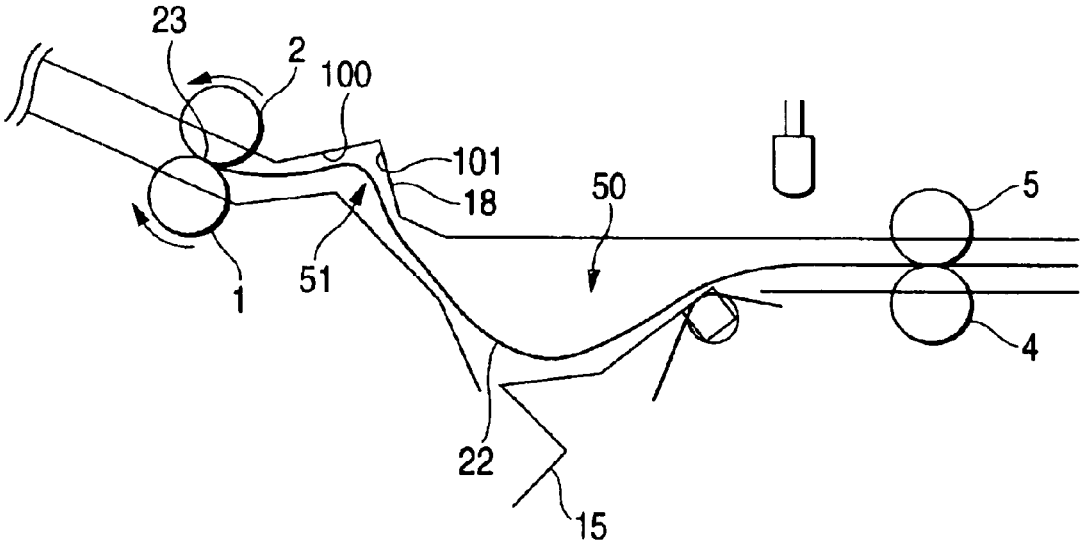
FIG. 4 is a diagram showing the operation of the sheet skew correcting apparatus of the invention.

FIGS. 3 and 4 are side views illustrating the operation of the sheet skew correcting apparatus. Hereinafter, the manner of the operation of the sheet skew correcting apparatus will be described with reference to FIGS. 3 and 4. First, the timing drive roller 4 and the timing idler roller 5 are rotated in the directions shown in FIG. 3. At this time, the sheet 22 is transported in the direction to the registration drive roller 1 and the registration idler roller 2, by the rotations of the timing drive roller 4 and the timing idler roller 5. When the front end of the sheet 22 is detected by the sensor 20, the number of rotations of the stepping motor 14 which is required for the front end of the sheet 22 to arrive the contact point 23 can be known because relationships between the number of rotation steps of the stepping motor 14 and the distance of a sheet transporting path from the sensor 20 to the contact point 23 between the registration drive roller 1 and the registration idler roller 2 are already apparent.

After the front end of the sheet 22 arrives the contact point 23 in this way, the stepping motor 14 is further rotated to transport the sheet by a distance which is larger than the distance of the sheet transporting path to the contact point, thereby forming a curve in the sheet 22 as shown in FIG. 4. Thereafter, the registration drive roller 1 and the registration idler roller 2 are rotated by an arbitrary angle in the directions of the arrows shown in FIG. 4, whereby the front end of the sheet 22 is vibrated to uniformly align the front end of the sheet 22 with the contact point 23. The sheet 22 which is sent out from the timing drive roller 4 and the timing idler roller 5 is smoothly introduced to the registration idler roller 2 in the vicinity of the contact point 23 by the expansion of the paper guide 17 upstream from the registration drive roller 1 and the registration idler roller 2, and also by the inclination of the first inclining portion 100. The sheet transporting path is expandingly bent toward the registration idler roller 2 by the expansion of the paper guide 17. After the front end of the sheet 22 abuts against the contact point 23, therefore, the sheet 22 forms a curve in the second curved portion 51. In the second curved portion 51, the inclination on the second inclining portion 101 is larger than that on the first inclining portion 100. Consequently, the repulsive force of the sheet 22 which is generated by the curving in the second curved portion 51 acts in a direction along which the front end of the sheet 22 is pressed against the contact point 23. Furthermore, the difference of the curving amount of the sheet 22 due to skew can be absorbed by the curve of the sheet 22 formed on the side of the paper guide 18. Therefore, an influence on the curve of the sheet 22 formed on the side of the buffer paper guide 15 can be reduced, and pressing can be performed while the curve of the sheet 22 produced on the side of the buffer paper guide 15 is made uniform in the width direction of the sheet 22.

Since the second curved portion 51 and the first curved portion 50 are alternately curved with respect to the sheet transporting path, the curving of the sheet 22 can form an S-like shape and the force of pressing the sheet 22 by the buffer paper guide 15 can be efficiently transmitted to the curve formed in the second curved portion 51. Therefore, the front end of the sheet 22 is aligned with the contact point 23, so that skew can be corrected. As a result, the state where the front end of the sheet 22 uniformly abuts against the contact point 23 can be maintained, and hence skew occurring in the sheet 22 can be easily corrected.

Since the second curved portion 51 is curved in a position opposed to the registration drive roller 1, the front end of the sheet 22 is pressed against the registration drive roller 1 by the repulsive force of the sheet 22 due to the curving in the second curved portion 51. During a process of reversely rotating the registration drive roller 1 to register the front end of the sheet 22, however, the front end of the sheet 22 is not rolled in the contact point 23 because the registration drive roller 1 is made of an elastic member of rubber hardness of 85° or higher and hence is less deformed. Therefore, it is possible to prevent damage such as breakage or deformation of the front end of the sheet 22 from occurring.

It is also possible to provide an image forming apparatus comprising: a cassette 21 of a sheet feeding apparatus and for housing sheets; the sheet skew correcting apparatus of this invention for correcting skew of a sheet fed out from the cassette; a developing/transferring section 300 (See FIG. 2) which forms an image on the sheet fed out from the cassette; a fixing section (not shown) which fixes the image transferred to the sheet in the developing/transferring section; a finisher (not shown) having a post processing apparatus including a stacker on which printed sheets are piled up, or a stapler; and the like. This image forming apparatus is capable of transporting sheets stably.

As described above, according to the invention, skew of even a sheet which is high in rigidity depending on the thickness and the kind can be effectively corrected.

What is claimed is:

1. A sheet skew correcting apparatus comprising:

a transporting path in which a sheet fed from a sheet feeding apparatus is transported in a sheet transporting direction;

a pair of registration rollers which face the transporting path;

a pair of timing rollers which face the transporting path and are disposed upstream from the registration rollers;

a paper guide including the transporting path between the registration rollers and the timing rollers; and a controller that controls the pair of registration rollers to rotate in a direction opposing the sheet transporting direction to correct skew, wherein the paper guide comprises a first curved portion and a second curved portion, the second curved portion being disposed upstream from the registration rollers and downstream from the first curved portion, and the first curved portion and the second curved portion are alternately curved.

2. The sheet skew correcting apparatus according to claim 1, wherein the registration rollers comprise an elastic roller and a hard roller, the hard roller having a smoother surface and being less deformed than the elastic roller; and the second curved portion is disposed on the same side of the paper guide as the hard roller with respect to the transporting path.

3. The sheet skew correcting apparatus according to claim 2, wherein the elastic roller comprises rubber.

4. The sheet skew correcting apparatus according to claim 3, wherein the elastic roller comprises hard rubber of rubber hardness of 85° or higher.

5. The sheet skew correcting apparatus according to claim 2, wherein the hard roller comprises plastic or metal.

6. The sheet skew correcting apparatus according to claim 1, wherein the first and second curved portions are alternately disposed with respect to a transportation face in the transporting path.

7. The sheet skew correcting apparatus according to claim 1, wherein a side of the second curved portion comprises a first inclining portion and a second inclining portion, the second inclining portion abutting on the first inclining portion from upstream;

the first inclining portion tapers the transporting path gradually in the transporting direction; and the second inclining portion tapers the transporting path gradually towards upstream.

8. The sheet skew correcting apparatus according to claim 7, wherein a first angle between an imaginary plane and the first inclining portion is equal to or less than a second angle between the imaginary plane and the second inclining portion, the imaginary plane being tangent to surfaces of both of the registration rollers and passing through a contact point where the registration rollers are in mutual contact.

9. The sheet skew correcting apparatus according to claim 8, wherein said first angle between the imaginary plane and the first inclining portion is 45° or smaller; and said second angle between the imaginary plane and the second inclining portion is 45° or larger.

10. The apparatus of claim 7, wherein the inclination of the second inclining portion is larger than that of the first inclining portion.

11. The sheet skew correcting apparatus according to claim 1, wherein the first curved portion comprises pressing means for pressing the sheet to the registration rollers.

12. The image forming apparatus according to claim 11, wherein the first curved portion comprises pressing means for pressing the sheet to the registration rollers.

13. The apparatus of claim 1, wherein the first curved portion and the second curved portion are alternately curved to form an S-like shape.

14. The apparatus of claim 1, wherein the second curved portion is curved in a position opposed to one of the pair of registration rollers that comprises a registration drive roller.

15. The apparatus of claim 1, wherein the registration rollers comprise an elastic roller and a hard roller, wherein the hard roller has a smoother surface and is less deformable than the elastic roller.

16. The apparatus of claim 1, wherein the controller further controls the pair of timing rollers to rotate in a sheet transporting direction while said pair of registration rollers rotate in the direction opposing the sheet transporting direction to correct skew.

17. The apparatus of claim 1, wherein the controller further controls the pair of timing rollers to rotate to feed a sheet by a distance which is larger than the distance of the transporting path between the pair of timing rollers and a contact point between the pair of registration rollers.

18. The apparatus of claim 17, further comprising a sensor that transmits a signal indicating a front end of said sheet to said controller.

19. An image forming apparatus comprising:

a sheet feeding apparatus which feeds a sheet;

a transporting path in which the sheet fed from the sheet feeding apparatus is transported in a sheet transporting direction;

a transferring apparatus which faces the transporting path and transfers a toner image to the sheet;

a pair of registration rollers which face the transporting path and are disposed upstream from the transferring apparatus;

a pair of timing rollers which face the transporting path and are disposed upstream from the registration rollers;

a paper guide including the transporting path between the registration rollers and the timing rollers; and a controller that controls the pair of timing rollers to continue to feed a sheet after a front end of the sheet arrives at said pair of registration rollers while controlling said pair of registration rollers to be one of stationary and rotating in a direction opposite of said sheet transporting direction, wherein the paper guide comprises a first curved portion and a second curved portion, the second curved portion being disposed upstream from the registration rollers and downstream from the first curved portion, and wherein the first curved portion and the second curved portion are alternately curved.

20. The image forming apparatus according to claim 19, wherein the registration rollers comprise an elastic roller and a hard roller, the hard roller having a smoother surface and being less deformed than the elastic roller; and the second curved portion is disposed on the same side of the paper guide as the hard roller with respect to the transporting path.

21. The image forming apparatus according to claim 20, wherein the elastic roller comprises rubber.

22. The image forming apparatus according to claim 21, wherein the elastic roller comprises hard rubber of rubber hardness of 85° or higher.

23. The image forming apparatus according to claim 20, wherein the hard roller comprises plastic or metal.

24. The image forming apparatus according to claim 19, wherein the first and second curved portions are alternately curved with respect to a transportation face in the transporting path.

25. The image forming apparatus according to claim 19, wherein a side of the second curved portion comprises a first inclining portion and a second inclining portion, the second inclining portion abutting on the first inclining portion from upstream;

the first inclining portion tapers the transporting path gradually in the transporting direction; and the second inclining portion tapers the transporting path gradually towards upstream.

26. The image forming apparatus according to claim 25, wherein a first angle between an imaginary plane and the first inclining portion is equal to or less than a second angle between the imaginary plane and the second inclining portion, the imaginary plane being tangent to surfaces of both of the registration rollers and passing through a contact point where the registration rollers are in mutual contact.

27. The image forming apparatus according to claim 26, wherein said first angle between the imaginary plane and the first inclining portion is 45° or smaller; and said second angle between the imaginary plane and the second inclining portion is 450° or larger.

28. The apparatus of claim 25, wherein the inclination of the second inclining portion is larger than that of the first inclining portion.

29. The apparatus of claim 19, the first curved portion and the second curved portion are alternately curved to form an S-like shape.

30. The apparatus of claim 19, wherein the second curved portion is curved in a position opposed to one of the pair of registration rollers that comprises a registration drive roller.

31. The apparatus of claim 19, wherein the registration rollers comprise an elastic roller and a hard roller, wherein the bard roller has a smoother surface and is less deformable than the elastic roller.

* * * * *